US007839365B2

(12) United States Patent
Knapp et al.

(10) Patent No.: US 7,839,365 B2
(45) Date of Patent: Nov. 23, 2010

(54) CONTROL OF CURRENT SUPPLIED BY A TRANSISTOR TO A PIXEL IN AN ELECTROLUMINESCENT DISPLAY DEVICE

(75) Inventors: Alan G. Knapp, Crawley (GB); David A. Fish, Haywards Heath (GB); Jurgen J. L. Hoppenbrouwers, Eindhoven (NL); Roel Van Woudenberg, Eindhoven (NL); Nijs C. Van Der Vaart, Rosmalen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1068 days.

(21) Appl. No.: 10/526,864

(22) PCT Filed: Aug. 22, 2003

(86) PCT No.: PCT/IB03/03803

§ 371 (c)(1),
(2), (4) Date: Mar. 4, 2005

(87) PCT Pub. No.: WO2004/023446

PCT Pub. Date: Mar. 18, 2004

(65) Prior Publication Data

US 2005/0264492 A1 Dec. 1, 2005

(30) Foreign Application Priority Data

Sep. 4, 2002 (GB) ..... 0220512.8
Jun. 13, 2003 (GB) ..... 0313656.1

(51) Int. Cl.
*G09G 3/30* (2006.01)

(52) U.S. Cl. ..... 345/77; 345/82

(58) Field of Classification Search ..... 345/76–83, 345/589

See application file for complete search history.

(56) References Cited

U.S. PATENT DOCUMENTS

| | | | | |
|---|---|---|---|---|
| 6,191,534 | B1 | 2/2001 | Schuler et al. | |
| 6,462,735 | B2 * | 10/2002 | Naito | 345/204 |
| 6,518,962 | B2 * | 2/2003 | Kimura et al. | 345/211 |
| 6,582,980 | B2 * | 6/2003 | Feldman et al. | 438/28 |
| 6,593,934 | B1 * | 7/2003 | Liaw et al. | 345/590 |
| 7,042,524 | B2 * | 5/2006 | Onagawa | 348/687 |
| 2002/0036716 | A1 * | 3/2002 | Ito et al. | 348/674 |
| 2002/0180680 | A1 * | 12/2002 | Moon | 345/89 |

(Continued)

FOREIGN PATENT DOCUMENTS

EP 0717446 A2 12/1995

(Continued)

*Primary Examiner*—Chanh Nguyen
*Assistant Examiner*—Allison Walthall

(57) ABSTRACT

In an active matrix electroluminescent display device, an overall brightness level of an image to be displayed in a frame period is determined. A drive transistor of each pixel is controlled in dependence on an input drive signal for the pixel and on the overall brightness level, for example using a signal processor (30) to vary the pixel drive signals. This arrangement can control the pixels to limit the maximum currents drawn by the pixels, thereby limiting the cross talk effects resulting from voltage drops along row or column conductors. If an image is bright, the pixel drive levels across the image (or at least a part of the image) can be reduced, so that the maximum brightness is reduced.

16 Claims, 5 Drawing Sheets

U.S. PATENT DOCUMENTS

| | | | | |
|---|---|---|---|---|
| 2003/0016189 | A1 * | 1/2003 | Abe et al. | 345/55 |
| 2003/0025718 | A1 * | 2/2003 | Mori | 345/690 |
| 2003/0052841 | A1 | 3/2003 | Tanaka et al. | |

FOREIGN PATENT DOCUMENTS

| | | | |
|---|---|---|---|
| EP | 0923067 | A1 | 3/1998 |
| EP | 1071070 | A2 | 1/2001 |
| EP | 1314141 | A2 | 10/2002 |
| JP | 09222871 | A | 8/1997 |
| JP | 2001305511 | A * | 10/2001 |
| WO | WO 9636959 | | 5/1996 |
| WO | 2004023446 | A1 | 3/2004 |

* cited by examiner

CONTROL OF CURRENT SUPPLIED BY A TRANSISTOR TO A PIXEL IN AN ELECTROLUMINESCENT DISPLAY DEVICE

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-addressed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a PMOS TFT, so that the storage capacitor 24 holds the gate-source voltage fixed. This results in a fixed source-drain current through the transistor, which therefore provides the desired current source operation of the pixel.

The above basic pixel circuit is a voltage-addressed pixel, and there are also current-addressed pixels which sample a drive current. However, all pixel configurations require current to be supplied to each pixel.

In a conventional pixel configuration, the power supply line 26 is a row conductor, and is typically long and narrow. The displays are typically backward-emitting, through the substrate carrying the active matrix circuitry. This is the preferred arrangement because the desired cathode material of the EL display element is opaque, so that the emission is from the anode side of the EL diode, and furthermore it is not desirable to place this preferred cathode material against the active matrix circuitry. Metal row conductors are formed, and for backward emitting displays they need to occupy the space between display areas, as they are opaque. For example, in a 12.5 cm (diameter) display, which is suitable for portable products, the row conductor may be approximately 11 cm long and 20 μm wide. For a typical metal sheet resistance of 0.2 Ω/square, this gives a line resistance for a metal row conductor of 1.1 kΩ. A bright pixel may draw around 8 μA, and the current drawn is distributed along the row. The voltage drops can be reduced to some extent by drawing current from both ends of the row, and improvements in efficiency of the EL materials can reduce the current drawn. Nevertheless significant voltage drops are still present. This problem is worsened for larger displays, even if the total line resistance can be kept the same. This is because there are more pixels per row, or alternatively larger pixels if the resolution is the same. The voltage variations along the power supply line alter the gate-source voltage on the drive transistors, and thereby affect the brightness of the display, in particular causing dimming in the center of the display (assuming the rows are sourced from both ends). Furthermore, as the currents drawn by the pixels in the row are image-dependent, it is difficult to correct the pixel drive levels by data correction techniques, and the distortion is essentially a cross talk between pixels in different columns.

According to the invention, there is provided an active matrix electroluminescent display device comprising an array of display pixels, each pixel comprising:

an electroluminescent (EL) display element; and active matrix circuitry including at least one drive transistor for driving a current through the display element, wherein the device further comprises:

means for determining an overall brightness level of an image to be displayed in a frame period; and means for controlling the at least one drive transistor of each pixel in dependence on a respective input signal providing a drive level for the pixel and in dependence on the overall brightness level.

This arrangement can control the pixels to limit the maximum currents drawn by the pixels, thereby limiting the cross talk effects described above. For example if an image is bright, the pixel drive levels across the image (or at least a part of the image) can be reduced, so that the maximum brightness is reduced. For a dark image, the maximum allowed pixel brightness can be increased. Of course, this is a distortion of the image. However, it has been recognized that a similar effect can be observed in CRT (cathode ray tube) display, where the brightness of an image is a function of the total light output. This in fact provides a realistic image. In particular, the increased brightness for small bright areas (such as reflections of sun from water) provides a realistic appearance. The implementation of this effect in an EL display enables the maximum current along the row conductors to be reduced, such that the voltage drops are not sufficient to cause noticeable non-uniformity or cross talk in the displayed image.

In one arrangement, a signal processing device determines an overall brightness level and processes the input signals for the pixels in dependence on the overall brightness level. This provides processing of the image data and requires no hardware modification. In this case a field store is preferably provided for storing the input signals for an image and the input signals for all pixels of the image in the field store are summed to determine the overall brightness.

A look up table can be used for modifying the input signals for the stored image in dependence on the overall brightness level.

In an embodiment of the invention gamma processing is used to control the peak brightness of the display. The gamma parameter is conventionally used in display or image technology indicating the display linearity in terms of e.g. input signal and output luminance. This may be done by recalculating or selecting a look-up table in dependence of the overall brightness level. As a result, for dark images the maximum allowed pixel brightness can be increased to provide the sparkling effect that is known for a CRT display.

In another arrangement, digital to analogue converter circuitry is used for converting digital inputs into the input signal, and the digital to analogue converter circuitry can then be controllable in dependence on the overall brightness level. In this case, the pixel drive signals are again modified before application to the pixels, but at the D/A conversion stage.

In other arrangements, the pixel configuration is used to provide the image modification.

In a first example, the active matrix circuitry can comprise first and second drive transistors in parallel each connected between a respective power supply line and the EL display element. The first drive transistor is supplied with a first supply voltage and the second drive transistor is supplied with a second supply voltage, with at least one of the supply voltages being variable in dependence on the on the overall brightness level. This enables the combined current supplied by the two drive transistors to be varied by setting the voltage of one supply voltage. This pixel arrangement is a modification of a conventional voltage addressed pixel.

The first supply voltage may be fixed and the second supply voltage variable, and the range of variation can include the first and second supply voltages being equal.

In a second example with a current driven pixel, the active matrix circuitry comprises current sampling circuitry for sampling an input drive current, the current sampling circuitry having a current sampling transistor and a drive transistor in parallel each connected to a respective power supply line. Each of the current sampling transistor and the drive transistor can supply current to the display element, and at least one of the supply voltages of the power supply lines is variable in dependence on the overall brightness level. This pixel arrangement is a modification of a conventional current addressed pixel.

The invention also provides a method of addressing an active matrix electroluminescent display device comprising an array of display pixels, in which each pixel comprises an electroluminescent (EL) display element and active matrix circuitry including at least one drive transistor for driving a current through the display element, the method comprising:

determining an overall brightness level of an image to be displayed in a frame period; and controlling the at least one drive transistor of each pixel in dependence on a respective input signal providing a drive level for the pixel and in dependence on the overall brightness level.

The overall brightness may be a measure of the total drive level for all pixels or an average value, and this depends on the specific implementation. This method enables the total current to be kept within limits by reducing the maximum brightness for generally bright images.

Controlling the at least one drive transistor may comprises processing the input signals for the pixels in dependence on the overall brightness level and then applying the processed input signals to the pixels. For example, the input signals may be modified using a look up table, the address of which is selected in dependence on the input signal and the overall brightness level.

If the input signals are in digital form, controlling the at least one drive transistor can comprise controlling the digital to analogue conversion of the digital input signal in dependence on the overall brightness level and then applying the analogue input signals to the pixels.

If the input signal comprises a current, controlling the at least one drive transistor may comprise sampling the input current using a sampling transistor, and supplying the display element with current from the sampling transistor and a drive transistor in parallel, wherein the supply voltage to at least one of the sampling transistor and the drive transistor is varied in dependence on the on the overall brightness level to vary the total current supplied to the display element.

The invention will now be described by way of example with reference to the accompanying drawings, in which.

Figure 1:
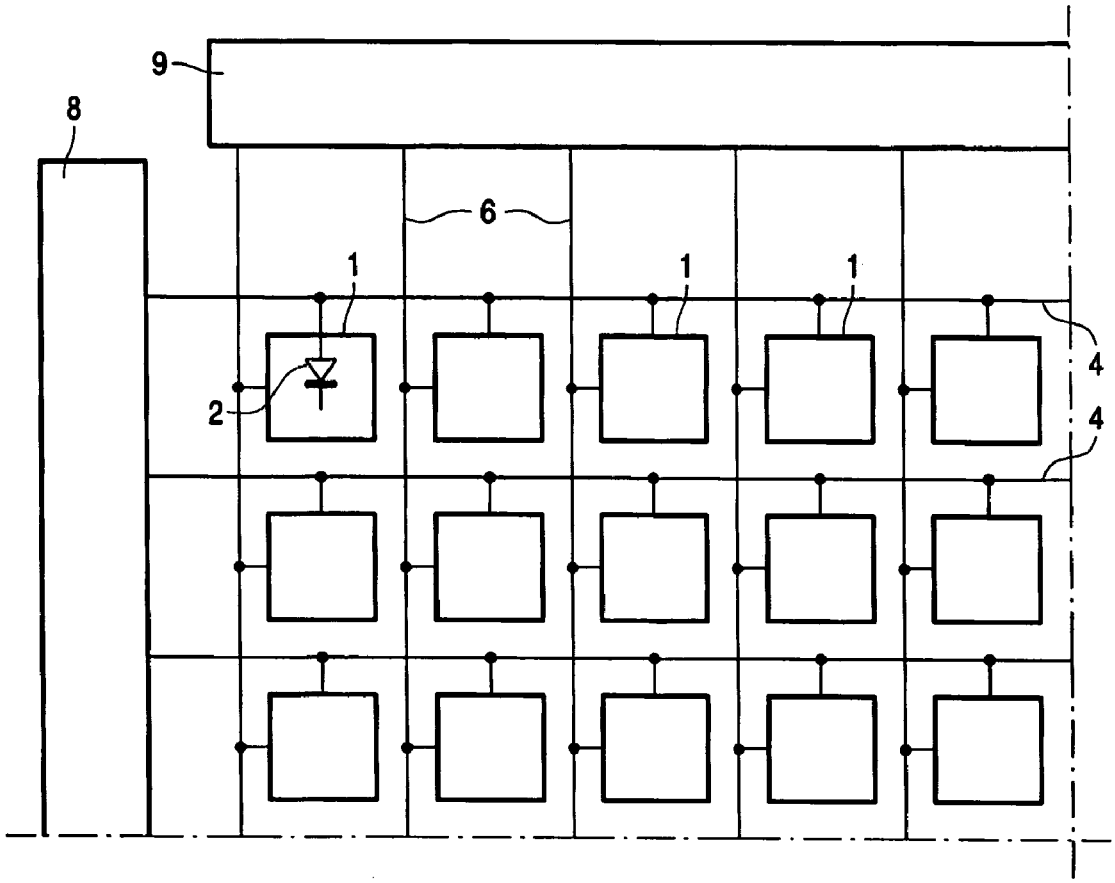
FIG.1 PRIOR ART
FIG. 1 shows a known EL display device.

It should be noted that these figures are diagrammatic and not drawn to scale. Relative dimensions and proportions of parts of these figures have been shown exaggerated or reduced in size, for the sake of clarity and convenience in the drawings.

The invention provides an active matrix electroluminescent display device in which an overall brightness level of an image to be displayed is determined, and the maximum pixel drive current within the field period corresponding to that image is controlled in dependence on the overall brightness level. In particular, the pixel drive levels for all pixels can be scaled in dependence on the overall brightness.

Limiting the maximum currents drawn by the pixels reduces cross talk. The resulting distortion of the image has been found to improve realism rather than detract from it.

Figure 3:
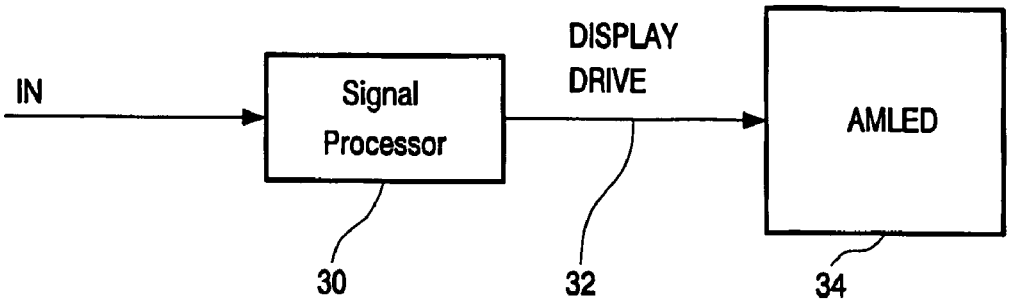
FIG. 3 shows a simplified schematic diagram of a first example of display device of the invention.

FIG. 3 shows a first way of implementing the invention. The pixel drive signals are provided to signal processor 30 which modifies them in dependence on the combined (integrated) brightness of all pixels in the image. The modified drive signals 32 are used to drive the display 34 in conventional manner. The processor adjusts the pixel drive signals (which may be currents or voltages) so that the peak pixel current and therefore brightness is higher for images where only a small part is very bright that for images where a large part is bright. This provides processing of the image data and requires no hardware modification.

Figure 4:
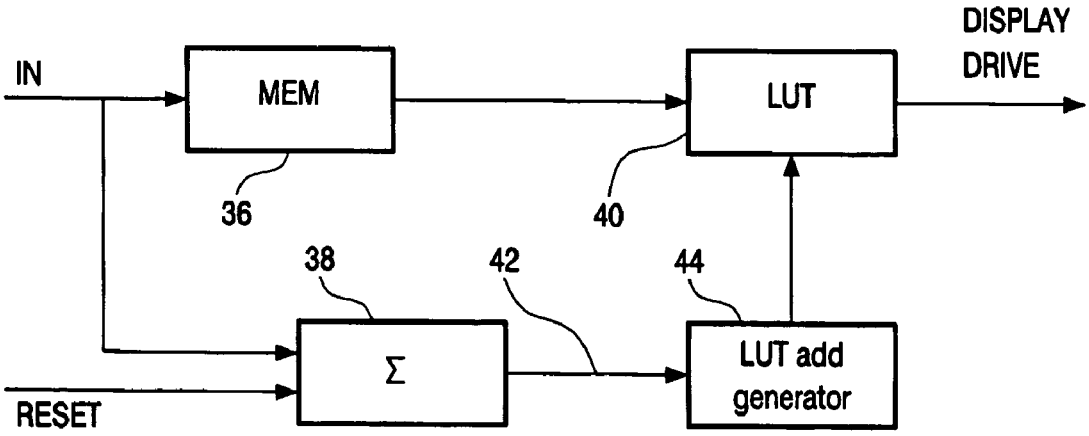
FIG. 4 shows in greater detail the implementation of FIG. 3.

FIG. 4 shows one possible implementation of FIG. 3 in greater detail. A field store 36 is provided for storing the input signals for a complete image, and the input signals for all pixels of the image are summed at the same time in a summing unit 38 to determine the overall brightness of the image. The summing unit thus outputs the combined pixel drive signals for the image stored in the field store 36.

A look up table (LUT) 40 is used for modifying the stored image pixel drive levels drive in dependence on the overall brightness level at the output of the summing unit 38. In particular, a signal 42 proportional to the sum of the brightness values of the incoming signal over a full field period is passed to a look up table address generator 44, which generates an address of the look up table to which the pixel drive levels of the stored image are applied before being used to drive the display. The look up table 40 essentially comprises two or more tables which are provided with different characteristics, and the selection of which table is used to convert the data is dependent on the brightness input. The field store requires a one frame delay to be implemented.

By processing the pixel drive signals, many different drive schemes can be implemented, either in hardware (with look up tables for example) or in software.

Figure 5A:
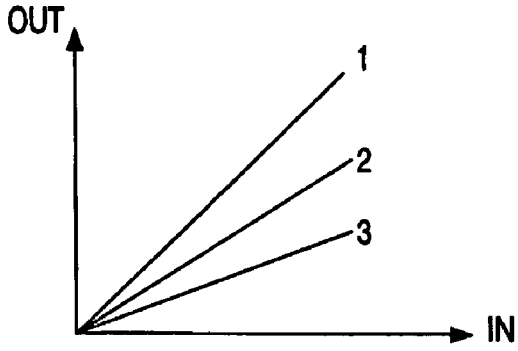
FIGS. 5A to 5C show some possible drive schemes which can be implemented with the circuit of FIG. 4.
Figure 5B:
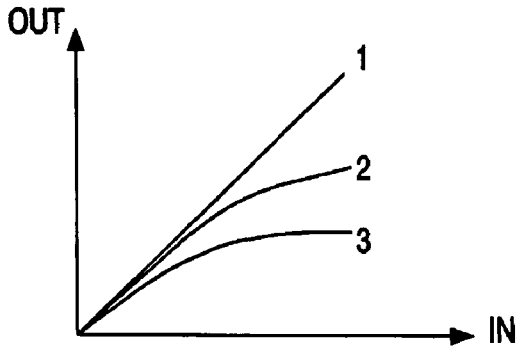
Figure 5C:
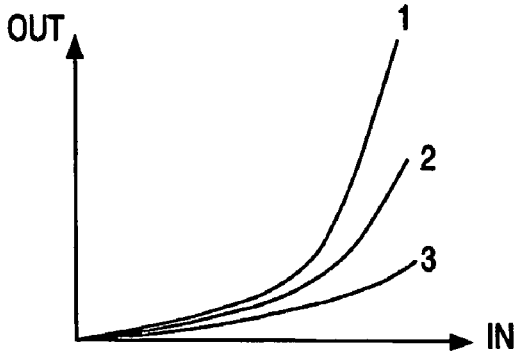

FIG. 5 shows three possible drive schemes. In each of FIGS. 5A to 5C, the graphs show how an input pixel drive level drive is modified to provide the output. The input and output may simply be considered as the original brightness level and the modified brightness level.

In FIG. 5A the three characteristics 1 to 3 are different linear gain values. Plot 1 provides no modification and is used for low brightness images where the maximum brightness can be tolerated. Plots 2 and 3 decrease the pixel brightness by different ratios, for images which are bright over progressively larger areas.

In FIG. 5B, plots 2 and 3 are non-linear and in FIG. 5C all three plots are non-linear. In each case, plot 1 is for the lowest brightness image and plot 3 is used for the highest brightness image.

The characteristic of FIG. 5C can be used for gamma processing in order to obtain the sparkling effect. This gamma correction is necessary because in current TV systems, the input video signals are processed to be displayed on a CRT display. On such a CRT display, the relation between the input signal and the output luminance L is of the form $L=(\text{input data})^{\gamma}$, with $\gamma$ between 2 and 3, resulting in a non-linear shape as in FIG. 5C. If the employed display has a different relation, the input data should be corrected accordingly, which is usually done by means of a Look-Up-Table. This correction mechanism may be adapted to control the maximum brightness of the display pixels via the diagram shown in FIG. 4. The video data is stored in memory (36). The overall brightness level of the image is determined (38) and the gamma correction LUT (40) is altered by a LUT generator (44) to set a certain maximum brightness depending on the overall brightness level. The total relation between input data and displayed luminance should have the shape of FIG. 5C. Images with a low overall brightness level will have a higher maximum output (curve 1) value than images with a high overall brightness level (curve 2 or 3).

FIG. 5 shows three possible scaling values for the image, but of course there may be many more, to a limit where is a continuous change in drive characteristics with brightness level.

In FIG. 4, the image modification is performed with look up tables. Of course, the modification of the pixel drive signals may be under the control of an algorithm or other software implementation. For example, the linear case of FIG. 5A can be implemented simply with a multiplier with a gain control signal (i.e. a control input for the multiplier) being derived from the overall brightness.

In FIG. 4, the analogue drive signals are modified before being used to drive the display. The image data will typically originally be in digital form, and in this case it can be manipulated in software much more readily.

Figure 6:
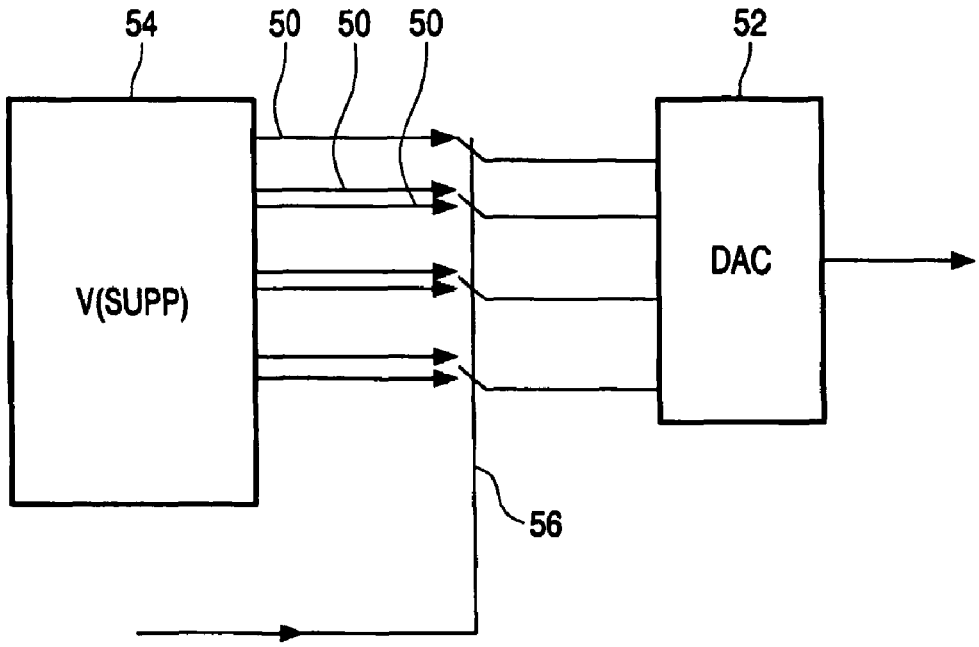
FIG. 6 shows a simplified schematic diagram of a second example of how to modify a display device in accordance with the invention.

Another alternative is shown in FIG. 6, in which the digital to analogue converter circuitry used for converting the digital image data into the analogue drive signals inputs is modified. The control voltages 50 for the D/A converter 52 are generated by voltage supply circuitry 54. For example, the D/A converter can be a resistor chain, and the input voltages which define the voltages on the resistor chain can be switched (schematically shown at 56) to very the output range and the way the output voltage varies across the range of digital input words. The control 56 is then dependent on the overall brightness of the image. Again, the pixel drive signals are modified before application to the pixels, but at the D/A conversion stage.

The manipulation of the image data provides the flexibility to implement numerous addition functions. These may optimize the system for particular display types or for particular types of image.

A timing controller can be incorporated which prevents sudden changes in gain from one field to the next. If small steps in gain are implemented, then when a change in overall brightness is detected, it may be desirable to step slowly from the current look up table (or algorithm, or D/A control) to the desired one in stages, so that sudden changes in the image are avoided. The same rate of change may be applied for increases in gain as for decreases in gain, or they may be different.

The overall brightness may take account more of the certain parts of the image, for example the center of the image. This may be appropriate if connections to the row and column conductors are made all around the display, because the resistance to the edges is much lower for pixels near the display edge so that the currents drawn by these pixels have less effect on the cross talk problem. The "overall brightness" thus may be derived from a portion of the image in the center or else may comprise a weighted measure with parts of the image near the edge contributing less to the summation.

In the examples above, the image data is modified before being applied to a conventional display device in conventional manner. It is also possible for the pixel configuration to be modified to provide the image modification.

Figure 2:
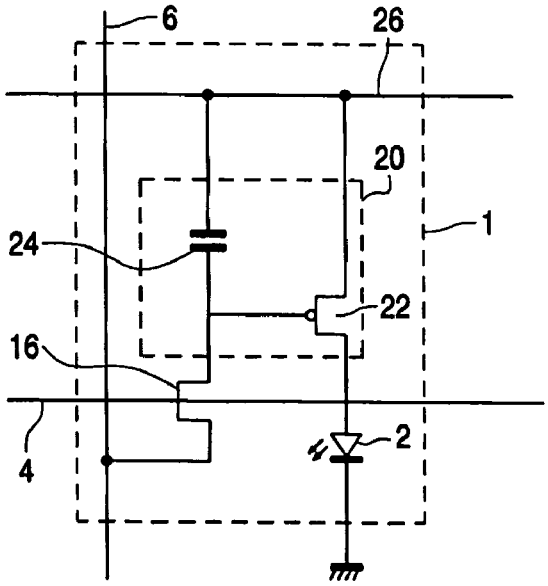
FIG.2 PRIOR ART
FIG. 2 is a simplified schematic diagram of a known pixel circuit for current-addressing the EL display pixel using an input drive voltage.
Figure 7:
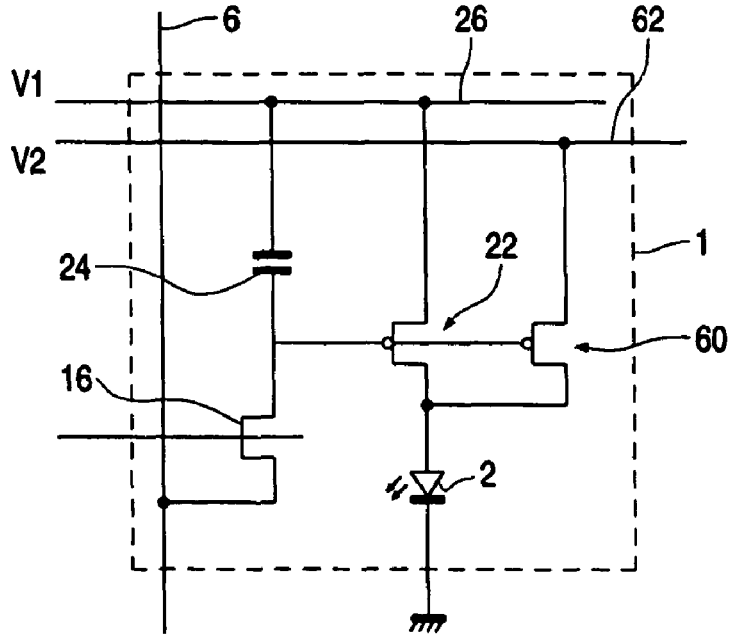
FIG. 7 shows a first example of a modified pixel for a display device of the invention.
Figure 8:
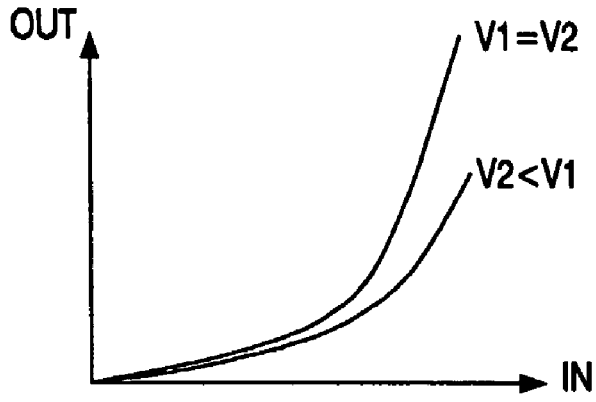
FIG. 8 shows possible drive schemes which can be implemented with the pixel circuit of FIG. 7.

FIG. 7 shows an arrangement in which the voltage driven pixel arrangement of FIG. 2 is modified to provide control of the peak brightness in accordance with the invention. All of the circuit element in FIG. 2 are repeated in FIG. 7 with the same reference numbers. FIG. 8 shows the transfer characteristic of the circuit.

The circuit is modified by providing a second drive transistor 60 in parallel with the first drive transistor 22, and connected between its own respective second power supply line 62 and the EL display element 2. The first and second drive transistors can thus be supplied with different supply voltages. The power supply line 26 has a fixed voltage V1 applied to it, but the voltage V2 applied to the second power line 62 can be varied in dependence on the image content.

If the overall image brightness is low, then the supply voltages are made equal, V1=V2, and the transfer characteristic is steep (see the top plot in FIG. 8) because the two drive transistors are in parallel. If the overall brightness increases to a point where problems with excess voltage drops occur in the conductors, then the voltage V2 is reduced to reduce the gate-source voltage. This means that the second drive transistor 60 is turned off at low values of input drive level (i.e. low gate-source voltages), and depending on the exact value of V2, the second drive transistor 60 starts to turn on for higher brightness level, but still operates at a lower current than when V1=V2. Thus, the transfer characteristic in FIG. 8 is less steep and the peak brightness is lower, hence the peak currents flowing.

In this arrangement, the combined current supplied by the two drive transistors is varied by setting the voltage of one supply voltage.

The circuits of FIGS. 2 and 7 are only example of voltage driven pixels, and other possibilities will be apparent to those skilled in the art.

Figure 9:
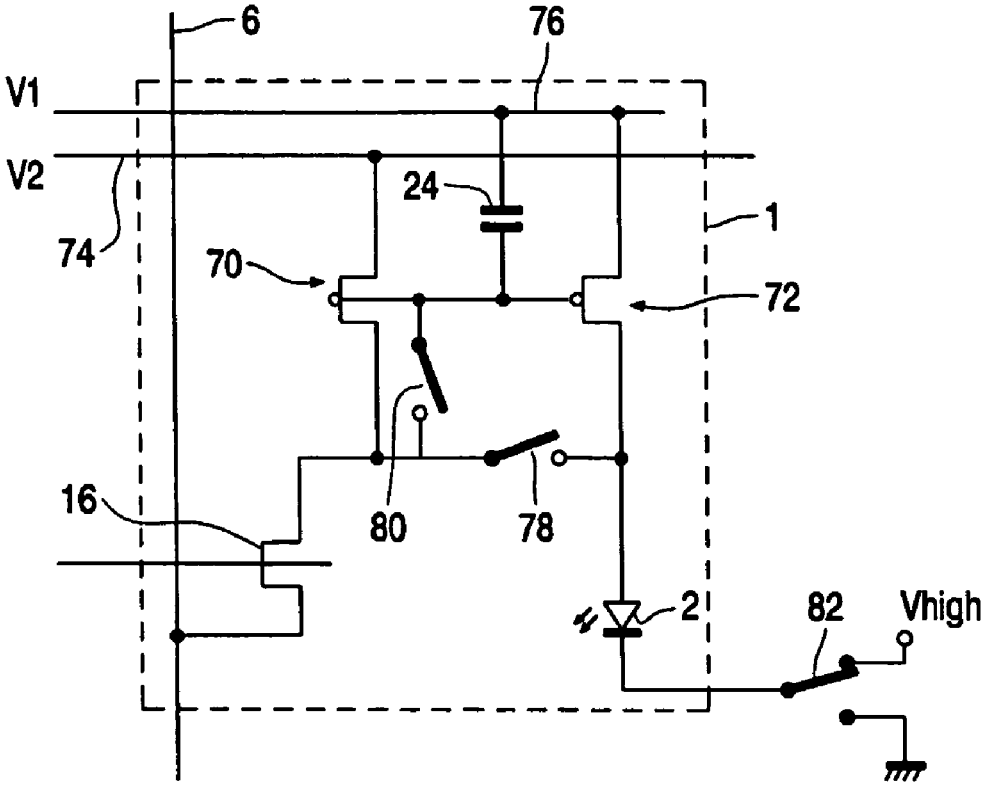
FIG. 9 shows a second example of a modified pixel for a display device of the invention.

FIG. 9 shows a current driven pixel layout modified in accordance with the invention.

The pixel 1 has current sampling circuitry for sampling an input drive current on the column conductor 6. The current sampling circuitry has a current sampling transistor 70 and a drive transistor 72 in parallel, each connected to a respective power supply line 74, 76. The current sampling transistor 70 and the drive transistor 72 can supply current to the display element 2.

The current to be sampled is supplied to the pixel through an address transistor 16, and a storage capacitor 24 stores a gate source voltage of the drive transistor 72, as in the pixel arrangement of FIG. 2.

To address the pixel circuit of FIG. 9, the voltages on the two power supply lines are equal, namely V1=V2. The address transistor 16 is turned on, and a first isolating switch 78 isolates the input current from the display element. A second isolating switch 80 is closed to allow charge to flow to the storage capacitor. When the circuit has reached a stable state, the current drawn by the column conductor 6 is sourced by the sampling transistor 70, and the storage capacitor holds the corresponding gate-source voltage of the sampling transistor. If the two transistors 70, 72 are matched, this also corresponds to the gate-source voltage of the drive transistor 72 for the same current.

The current mirror can however be asymmetric with the two transistors having different sizes—in this case the pixel itself provides some gain.

All pixels are programmed (i.e. the storage capacitors charged) with V1=V2. Furthermore, the cathode of the EL display element 2 is held high by switch 82 to reverse bias all the display elements. Once the average or combined brightness is known, the power level V2 is reset according to overall brightness.

If the overall brightness is low, then power level V2 is set just below V1 so that bright pixels (at least) receive current from both the sampling transistor and the drive transistor. If the overall brightness is high, then power level V2 is set lower to completely turn off the sampling transistor.

After the value of V2 is set, the switch 82 switches to earth to turn on the display elements and the isolating switch 78 is closed and switch 70 open, so that both transistors can supply current to the display element 2.

The pixel transfer characteristic is again modified by selection of V2, and the current mirror pixel has the advantage that non-uniformity of transistor characteristics is no longer an issue (as it is with the circuit of FIG. 2). A field store is not required in this case. Instead, an accumulator can sum the drive currents during the programming stage to enable the overall brightness to be evaluated. Thus, the field period is divided into two parts—a pixel programming part when the LEDs are off and an LED driving part where no pixels are programmed. The pixels thus act as the field store. Whilst the pixels are being programmed, hardware in the driver circuitry will be accumulating the data to find a total brightness figure by the time all pixels have been programmed. This allows the level of the second power line to be set and then the LEDs are driven.

The isolating switches are of course implemented as transistors.

Essentially, the invention involves determining an overall brightness level of an image to be displayed in a frame period; and controlling each pixel in dependence on the original pixel drive signal and in dependence on the overall brightness level. As will be apparent from the above, there are numerous ways in which this can be implemented, either in hardware or in software and either in the digital or analogue domain. The invention can be used for voltage or current addressing schemes.

Various modifications will be apparent to those skilled in the art. For example, the circuits above use PMOS drive transistors. There are also NMOS implementations.

The invention claimed is:

1. An active matrix electroluminescent display device including an array of display pixels, comprising:

an electroluminescent (EL) display element;

active matrix circuitry including first and second drive transistors for driving a current through the display element, wherein the first and second drive transistors are in parallel, each connected between a respective power supply line and the EL display element, the input to the pixel being provided to the gates of the first and second drive transistors, and wherein the first drive transistor is supplied with a first supply voltage and the second drive transistor is supplied with a second supply voltage, at least one of the supply voltages being variable in dependence on the combined brightness level;

means for determining a combined brightness level of a multitude of pixels in an image to be displayed in a frame period; and means for controlling the first and second drive transistors of each pixel individually in dependence on a respective input signal providing a drive level for the pixel and in dependence on the combined brightness level of the multitude of pixels in the image, wherein the means for controlling the first and second drive transistors comprises a signal processing device for determining an combined brightness level and for processing the input signals for the pixels in dependence on the combined brightness level, wherein the signal processing device is adapted to employ gamma characteristics for processing the input signals in dependence on the combined brightness level, wherein said gamma characteristics comprising a gamma correction LUT altered by a LUT generator to set a certain maximum brightness level depending on the combined brightness level.

2. The device as claimed in claim 1, wherein the signal processing device comprises a field store for storing the input signals for an image and a summation unit for summing the input signals for the multitude of pixels of the image in the field store to determine the combined brightness.

3. The device as claimed in claim 2, wherein the signal processing device further comprises a look up table for modifying the input signals for the stored image in dependence on the combined brightness level.

4. The device as claimed in claim 3, wherein the signal processing device is adapted to calculate or select the look-up table in dependence on the combined brightness level.

5. The device as claimed in claim 1, wherein the signal processing device operates to reduce the maximum brightness level to which any pixel is driven in response to an increase in the combined brightness of an image.

6. The device as claimed in claim 1, wherein the signal processing device comprises digital to analogue converter circuitry for converting digital inputs into the input signal, and wherein the digital to analogue converter circuitry is controllable in dependence on the combined brightness level.

7. The device as claimed in claim 1, wherein the input to the pixel is provided to the gates of the first and second drive transistors through an address transistor.

8. The device as claimed in claim 1, wherein the first supply voltage is fixed and the second supply voltage is variable.

9. The device as claimed in claim 8, wherein the first and second supply voltages can be equal.

10. A method of addressing an active matrix electroluminescent display device comprising an array of display pixels, an electroluminescent (EL) display element and active matrix circuitry including first and second drive transistors for driving a current through the display element, the method comprising:

determining a combined brightness level of a multitude of pixels in an image to be displayed in a frame period;

wherein the means for controlling the first and second drive transistors at least one comprises a signal processing device for determining an combined brightness level and for processing the input signals for the pixels in dependence on the combined brightness level, wherein the signal processing device is adapted to employ gamma characteristics for processing the input signals in dependence on the combined brightness level, wherein said gamma characteristics comprising a gamma correction LUT altered by a LUT generator to set a certain maximum brightness level depending on the combined brightness level, and controlling the first and second drive transistors of each pixel individually in dependence on a respective input signal providing a drive level for the pixel and in dependence on the combined brightness level of the multitude of pixels in the image, and wherein the first and second drive transistors are in parallel, each connected between a respective power supply line and the EL display element, the input to the pixel being provided to the gates of the first and second drive transistors, and wherein the first drive transistor is supplied with a first supply voltage and the second drive transistor is supplied with a second supply voltage, at least one of the supply voltages being variable in dependence on the combined brightness level.

11. The method as claimed in claim 10, wherein controlling the first and second drive transistors comprises processing the input signals for the pixels in dependence on the combined brightness level and then applying the processed input signals to the pixels.

12. The method as claimed in claim 11, wherein determining the combined brightness level comprises storing the input signals for an image and summing them.

13. The method as claimed in claim 11, wherein processing the input signals comprising modifying the input signals using a look up table, the address of which is selected in dependence on the input signal and the combined brightness level.

14. The method as claimed in claim 11, wherein processing of the input signals is performed by employing gamma characteristics of the array of display elements.

15. The method as claimed in claim 10, wherein the control of the first and second drive transistors reduces the maximum brightness level to which any pixel is drive in response to an increase in the combined brightness of an image.

16. The method as claimed in claim 10, wherein the input signals are in digital form, and controlling the first and second drive transistors comprises controlling the digital to analogue conversion of the digital input signal in dependence on the combined brightness level and then applying the analogue input signals to the pixels.

* * * * *